United States Patent [19]

Ruckle et al.

[11] Patent Number: 4,631,092

[45] Date of Patent: Dec. 23, 1986

[54] METHOD FOR HEAT TREATING CAST TITANIUM ARTICLES TO IMPROVE THEIR MECHANICAL PROPERTIES

[75] Inventors: Duane L. Ruckle; Ponciano P. Millan, Jr., both of Mesa, Ariz.

[73] Assignee: The Garrett Corporation, Los Angeles, Calif.

[21] Appl. No.: 662,212

[22] Filed: Oct. 18, 1984

[51] Int. Cl.[4] ..... C22F 1/18

[52] U.S. Cl. ..... 148/3; 148/11.5 F; 148/12.7 B; 148/133; 148/158; 148/421

[58] Field of Search ..... 148/11.5 F, 12.7 B, 148/133, 158, 407, 421, 3, 131; 420/418

[56] References Cited

U.S. PATENT DOCUMENTS

| | | | |
|---|---|---|---|
| 2,609,576 | 9/1952 | Roush et al. . | |
| 2,679,669 | 6/1954 | Kempe . | |
| 2,687,278 | 8/1954 | Smith et al. . | |
| 2,819,194 | 1/1958 | Herres et al. . | |
| 2,972,805 | 2/1961 | Hignett et al. . | |
| 3,316,626 | 5/1967 | Fredericks . | |
| 3,694,264 | 9/1972 | Weinland . | |
| 3,748,194 | 7/1973 | Ruckle et al. | 148/12.7 B |
| 3,758,347 | 9/1973 | Stalker et al. | 148/131 |
| 3,901,743 | 8/1975 | Sprague et al. | 148/12.7 B |
| 3,957,104 | 5/1976 | Terpay . | |
| 3,963,525 | 6/1976 | Bomberger, Jr. et al. | 148/2 |
| 4,053,330 | 10/1977 | Henricks et al. | 148/11.5 F |
| 4,087,292 | 5/1978 | Neal et al. | 148/407 |
| 4,098,623 | 7/1978 | Ibaraki et al. | 148/133 |
| 4,134,758 | 1/1979 | Nagai et al. | 148/133 |
| 4,283,822 | 8/1981 | Muth et al. | 29/156.8 H |
| 4,302,256 | 11/1981 | Kenton | 148/4 |
| 4,309,226 | 1/1982 | Chen | 148/12.7 B |
| 4,314,007 | 2/1982 | Gessinger | 428/614 |
| 4,434,835 | 3/1984 | Willgoose . | |
| 4,482,398 | 11/1984 | Eylon et al. | 148/133 |

FOREIGN PATENT DOCUMENTS 600762 6/1960 Canada .

OTHER PUBLICATIONS

Industrial Heating, "Hot Isostatic Pressing–A New Heat Treating Technology with Tremendous Potential", Jun. 1979, pp. 8–10.

*Primary Examiner*—Wayland Stallard

*Attorney, Agent, or Firm*—J. Henry Muetterties; A. J. Miller; James W. McFarland

[57] ABSTRACT

Cast titanium alloys and a method of heat treating the alloys in order to obtain fatigue and mechanical properties comparable to wrought titanium is disclosed. The heat treatment is practiced by solution heat treating a cast titanium article above its beta transus, rapidly cooling, stabilizing at a temperature within the alloy's alpha/beta phase range, and finally aging the article to achieve the desired properties.

22 Claims, 7 Drawing Figures

MICROSTRUCTURE OF CAST, NOT HEAT TREATED TITANIUM ALLOY (TI-6AI-4V).

FAN BLADE HEAT TREATED ABOVE BETA TRANSUS TEMPERATURE.

TYPICAL MICROSTRUCTURE OF CAST TITANIUM ALLOY HEAT TREATED TO 1925°F / 30 MINUTES / FAST QUENCHED PLUS 1500°F / 30 MINUTES AIR COOL PLUS 1300°F / 2 HOURS / AIR COOL.

TYPICAL MICROSTRUCTURE OF CAST TITANIUM ALLOY HEAT TREATED TO 1925°F / 30 MINUTES / FAST QUENCHED PLUS 1600°F / 30 MINUTES / AIR COOL PLUS 1300°F / 2 HOURS / AIR COOL.

TYPICAL MICROSTRUCTURE OF CAST TITANIUM ALLOY HEAT TREATED TO 1925°F / 30 MINUTES / FAST QUENCHED PLUS 1750°F / 30 MINUTES / AIR COOL PLUS 1300°F / 2 HOURS / AIR COOL.

METHOD FOR HEAT TREATING CAST TITANIUM ARTICLES TO IMPROVE THEIR MECHANICAL PROPERTIES

BACKGROUND AND SUMMARY OF THE INVENTION

This invention relates to the field of thermal processing of cast articles and more particularly to a method of heat treating cast alpha/beta titanium alloys and the articles produced thereby.

The alpha/beta titanium alloys are well known in the art and are described in "Titanium and Titanium Alloys Source Book" published by the American Society for Metals (1982). In particular, the physical metallurgy, properties, microstructure and conventional processing of titanium castings are discussed in this publication in Pages 289–300. The alpha/beta titanium alloys and processes applicable thereto are the subject of U.S. Pat. Nos. 3,007,824, 3,405,016, 3,748,194, 3,901,743, 4,053,330. U.S. Pat. No. 3,007,824 discloses a surface hardening process applicable to a specific alpha/beta alloy which involves heating the article to a temperature within the beta phase field and then quenching. No further heat treatment or modification of the resulting microstructure is utilized. U.S. Pat. No. 3,405,016 describes a heat treatment to improve the formability of alpha/beta titanium alloys which involves quenching from the beta phase field followed by mechanical deformation in the alpha/beta phase field. U.S. Pat. No. 4,053,330 describes a method for improving the fatigue properties of titanium alloy articles which requires deformation in the beta phase field to refine the beta grain size, followed by rapid quenching to a martensitic structure and tempering in the range of 1000° to 1600° F. to partially convert the martensite to acicular alpha and cause the formation of discrete equiaxed beta particles at the acicular alpha boundaries.

Titanium alloys are often used in applications where a high ratio of mechanical properties to weight is important. Specifically, such alloys are typically used in dynamic applications such as fan and compressor blades in gas turbine engines where a high level of tensile and fatigue strengths is critical. However, these strength characteristics of the selected alloy must be accompanied by good toughness, and high resistance to impact damage and crack propagation. The alpha/beta titanium alloys in which the alpha and beta phases are present at low temperatures are commonly used for these applications. In order to use these alloys effectively in such dynamic applications the wrought or forged processing conditions are conventionally utilized because of their superior fatigue strength compared to that of castings produced from the same alloys. Similarly, critical static structural use of titanium castings in gas turbine engines has often been limited by the inferior mechanical properties compared to that of forgings. Nevertheless, the lower cost of titanium castings compared to machined forgings establishes a significant incentive to improve the properties of castings so that they are competitive with those of forgings.

In many gas turbine engine applications the ability to utilize a cast titanium alloy article with an attractive balance of tensile strength, impact and crack propagation characteristics is particularly desirable. Such applications include but are not limited to hollow titanium airfoil shapes such as blades and vanes. In many cases hollow components are necessary to reduce component weight or to improve their functional performance. For example hollow titanium airfoils allow fan stage blades to be designed with high structural stiffness to weight ratios. Hollow titanium fan airfoils make it possible to eliminate the midspan shroud which is often used to eliminate excessive blade vibratory deflection due to aerodynamic loading. Very low aspect ratio airfoils become possible as a result of hollow blade construction which can also result in improved aerodynamic efficiency and improved resistance to impact from ingested foreign objects such as birds.

The construction of such hollow titanium airfoils has been demonstrated by several schemes of manufacture including the welding, brazing or diffusion bonding of multiple pieces to produce a single hollow structure. However, each of these approaches has associated undesirable aspects such as excessive cost, metallurgical inhomogeneity in chemistry or microstructure or difficulty in controlling the presence of sharp internal notches which can lead to premature fatigue failure. A hollow cast titanium airfoil produced by conventional investment casting practice utilizing a leachable internal core minimizes or eliminates these shortcomings when processed according to this invention.

It is the object of this invention to provide a cast titanium fan blade, solid or hollow, having a controlled alpha/beta structure derived from a prior martensitic condition.

It is another object of this invention to provide a cast titanium alloy hollow fan blade having fatigue strength comparable to a wrought fan blade.

It is a further object of this invention to provide a process for transforming the microstructure of a cast titanium alloy into an alpha/beta phase structure derived from a prior martensitic condition.

Cast titanium alloy articles produced from the class of titanium alloys which contain both alpha and beta stabilizer may be heat treated by the method of this invention to improve their fatigue behavior while maintaining high resistance to impact damage and propagation of cracks. The process produces a metallurgical structure of randomly oriented acicular alpha, with no large colonies of similarly aligned alpha platelets, and with control over the width of individual alpha platelets which leads to a very desirable and advantageous balance of fatigue properties with other mechanical properties.

The present invention is practiced by heat treating a cast titanium alloy article at a temperature above its beta transus temperature for a time sufficient to achieve a substantially beta microstructure, and thereafter rapidly cooling the article to produce an acicular martensitic microstructure. The resulting martensite is then thermally decomposed by stabilizing the article at a temperature within the alpha/beta phase field to form acicular alpha and beta phases, and to grow the alpha platelets to a predetermined thickness to provide them with the desired characteristics. Thereafter, the article is cooled to room temperature. The article is then aged by reheating it to a temperature between about 1000° to 1300° F. for a time of about 1 to 8 hours to partially decompose the beta phase, thereby achieving the final desired properties.

DETAILED DESCRIPTION OF A PREFERRED EMBODIMENT OF THE INVENTION

Figure 1:
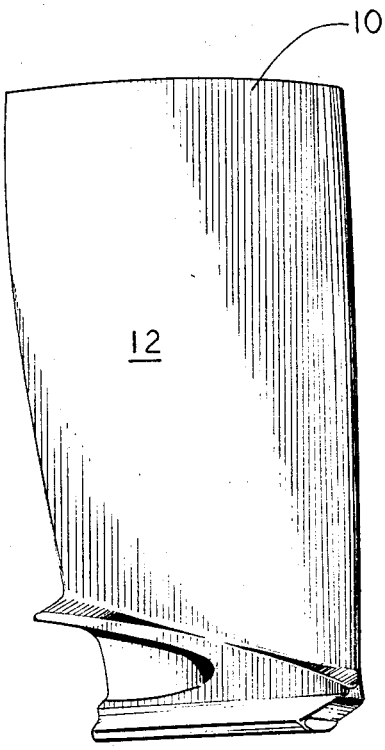
FIG. 1 shows a perspective view of a gas turbine fan airfoil made according to the present invention.
Figure 2:
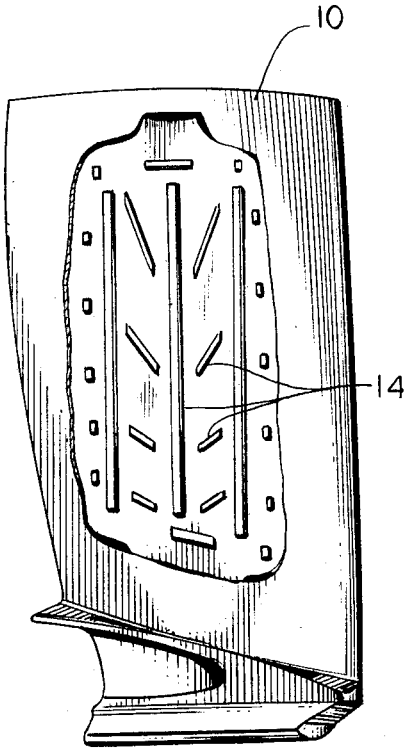
FIG. 2 shows the airfoil of FIG. 1 with the outer skin removed to reveal the internal rib design.

Referring generally to FIGS. 1 and 2, there is shown a final cast article, e.g. a gas turbine fan airfoil 10 made according to the present invention. The airfoil 10 is of a hollow cast construction, having an outer skin 12 and a plurality of internal ribs 14 therein. The internal rib design is shown as a matter of example and is not specific to the invention.

In practicing the present invention, a slightly oversized titanium blade is cast around a leachable core by a conventional vacuum skull melting process. The leachable core is composed of a ceramic binder such as a silica bonded yttrium oxide. Once the cast titanium alloy has sufficiently cooled, the mold is removed and the cast article is placed into a leaching agent or caustic solution, e.g. potassium hydroxide or sodium hydroxide, to remove the core material leaving a cast hollow titanium article. The caustic solution attacks the core, but not the metal of which the article is made.

After leaching, the cast titanium article has what is known as a layer of oxygen enrichment (alpha case) thereon. This layer has been created by the reactive nature of the molten titanium alloy being used with both the ceramic investment mold and the ceramic material in the leachable core. The oxygen enrichment layer is brittle and is therefore undesirable due to its susceptibility to crack formation and propagation during use.

Removal of the oxygen enriched layer is accomplished by either chemically or mechanically machine milling the contaminated layer from the surface of the cast article. Chemical removal is effected by dipping the article into a solution such as a mixture of nitric and hydroflouric acid. In the case of a hollow article the acid is able to flow into the interior of the article in order to chemically mill the oxygen enriched alpha layer created by the reaction of the titanium with the leachable core.

Following removal of its oxygen enriched layer, the article is placed directly into a hot isostatic press and consolidated, at a predetermined temperature and pressure for a predetermined time period. For the illustrated cast titanium fan airfoil 10 the hipping temperature is between approximately 1650° F. and approximately 1850° F., and the hipping pressure is approximately 15,000 psia (ksi). The article is subjected to this hot isostatic pressure and temperature of approximately 1 to 3 hours in an argon atmosphere.

As is well known in the metallurgical art, it is the object of hot isostatic pressing to collapse internal voids which have been formed during the casting process in order to eliminate any appreciable degree of blade porosity. After subjecting the article to hot isostatic pressing the surface area is inspected for defects. Any existing surface defects can be repaired by conventional titanium welding techniques.

HEAT TREATMENT OF THE AIRFOIL

After the hipping of the airfoil 10 it is subjected to a unique heat treatment process which provides the airfoil with mechanical properties comparable to those of a wrought titanium alloy airfoil, at a substantially lower fabrication cost.

In the application of the heat treatment process of the present invention to the Ti-6%Al-4%V alloy, of which the illustrated blade 10 is formed, the essential steps of the process are first to heat the article to a temperature at or above its beta transus temperature for a time which is sufficient to achieve the formation of an all beta structure. The beta transus temperature for the Ti-6%Al-4%V alloy is about 1825° F. (997° C.) but varies approximately ±25° F. depending on the precise chemistry. The time the article is exposed to a temperature within the beta phase field is not critical and may be less than one minute, however in samples with varying cross sections or thicknesses it is important that sufficient time be allowed so that all areas of the component achieve a temperature which is above the beta transus temperature; i.e. the temperature above which the microstructure is converted to all beta phase. For example, for a typical fan blade as shown in FIGS. 1 and 2, having a 0.05 inch skin and 0.5 inches root section thickness, 30 minutes has been found to be adequate to ensure that the entire workpiece is exposed to its beta transus temperature. The beta transus temperature may also be considered to be the lower boundary of the beta phase field. The temperature within the beta phase field should be limited to less than approximately 150° F. above the beta transus temperature so as to limit the growth of the beta grains, although temperatures higher than this will also result in satisfactory results for many thick section articles where the beta grain size is much less than the minimum section dimension.

In practice it has been found that the temperature of heating within the beta phase field is most favorable between about 1875° F. to 1925° F. for a solid gas turbine fan blade article of the Ti-6%Al-4%V alloy. The total time of heating has been found to be favorable when limited to 15 to 30 minutes. It has further been found that this heating step is most favorably accomplished in a vacuum or protective inert gas atmosphere to avoid excessive oxygen and nitrogen contamination of the surface, although heating in air has been found to be satisfactory when the resulting contaminated surface is removed by machining or dissolution with suitable aggressive chemicals such as a mixture of nitric and hydrofluoric acids.

Figure 3:
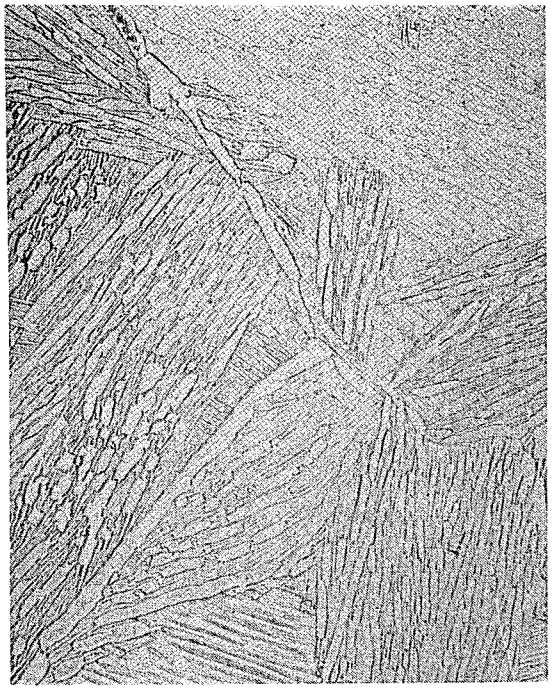
FIG. 3 is a photomicrograph of the Ti-6Al-4V fan blade as cast.
Figure 3:
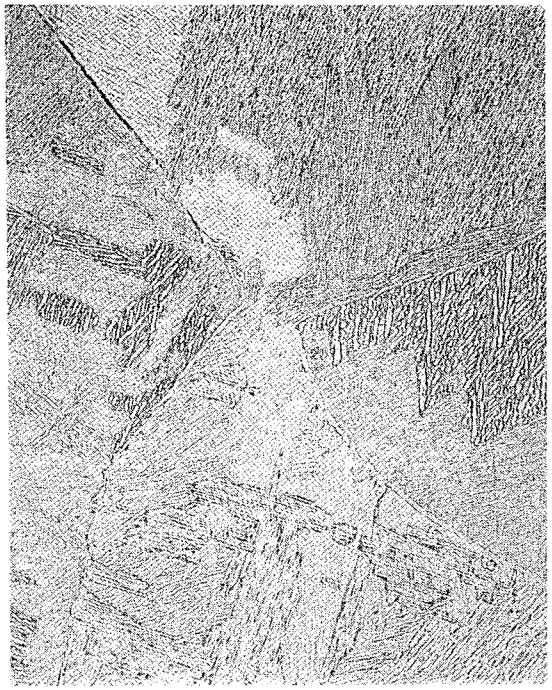
Figure 4:
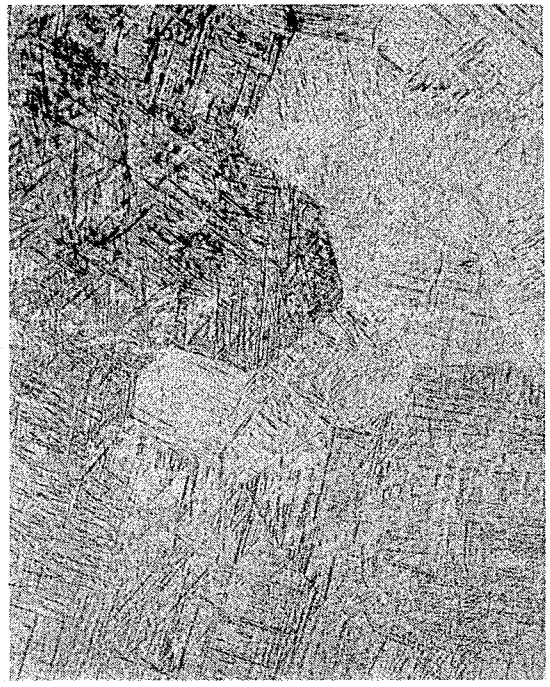
FIG. 4 is a photomicrograph of the fan blade after being subjected to heat treatment above the alloy's beta transus temperature and rapid quenching according to this invention.
Figure 4:
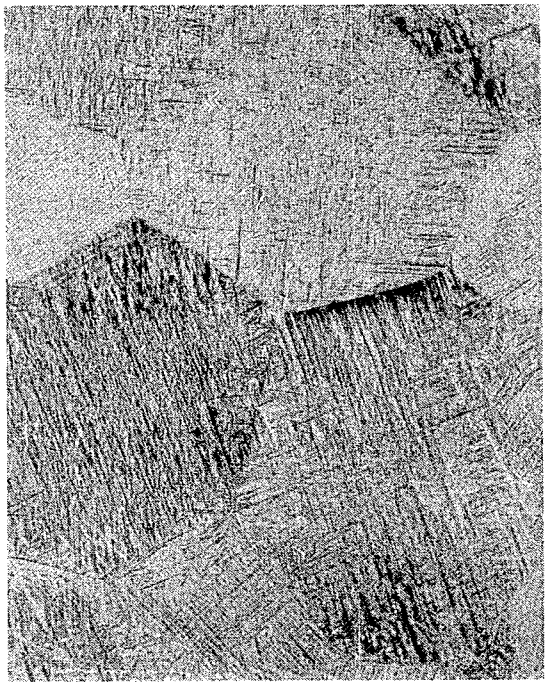

The second step in the invention is to rapidly cool the article from above the beta transus temperature to a relatively low temperature—for example, room temperature. A liquid quench such as oil or water has been found to be satisfactory although other quenching media such as argon or helium gas may be utilized. The rapid quench is required to obtain a uniform martensite structure throughout the article with minimum nucleation and growth of the conventional alpha phase. The rate of cooling from the beta phase field temperature must be sufficiently high to achieve this essential martensitic structure. This structure exhibits a randomly oriented array of fine martensite needles as shown in FIG. 4. This may be contrasted with the structure of a conventional titanium alloy casting shown in FIG. 3 which can be seen to exhibit large colonies of similarly oriented alpha platelets.

The third step in the invention process is to expose the quenched martensitic article to an elevated temperature within the alpha/beta phase field (1500°–1825° F.) to decompose the martensite to alpha and beta platelets.

Figure 5:
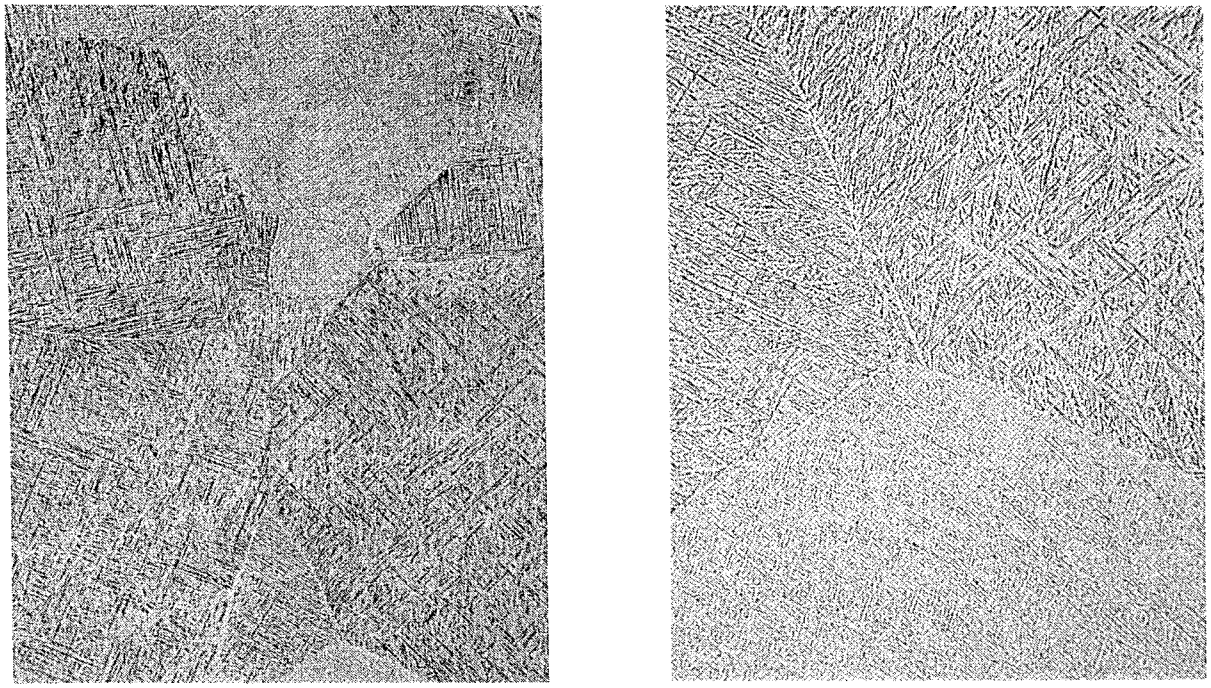
FIG. 5 is a photomicrograph of the fan blade after being subjected to the stabilization temperature of 1500° F. for 30 minutes.
Figure 6:
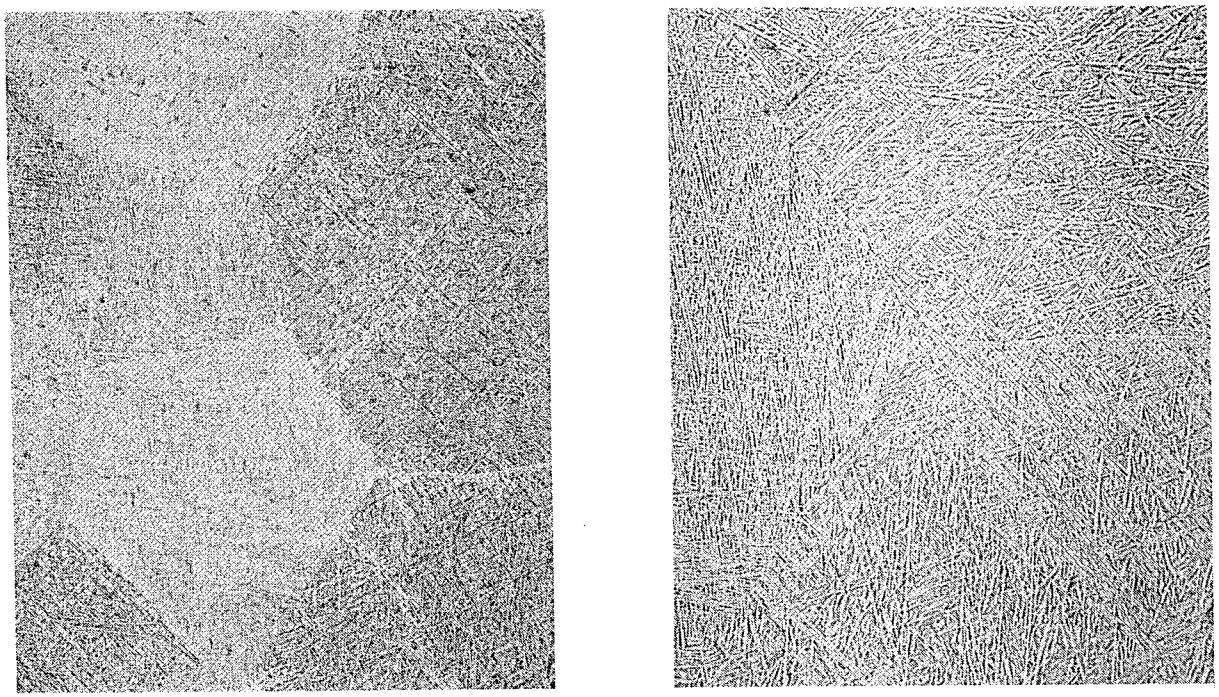
FIG. 6 is a photomicrograph of a second fan blade after being subjected to the stabilization temperature of 1600° F. for 30 minutes.
Figure 7:
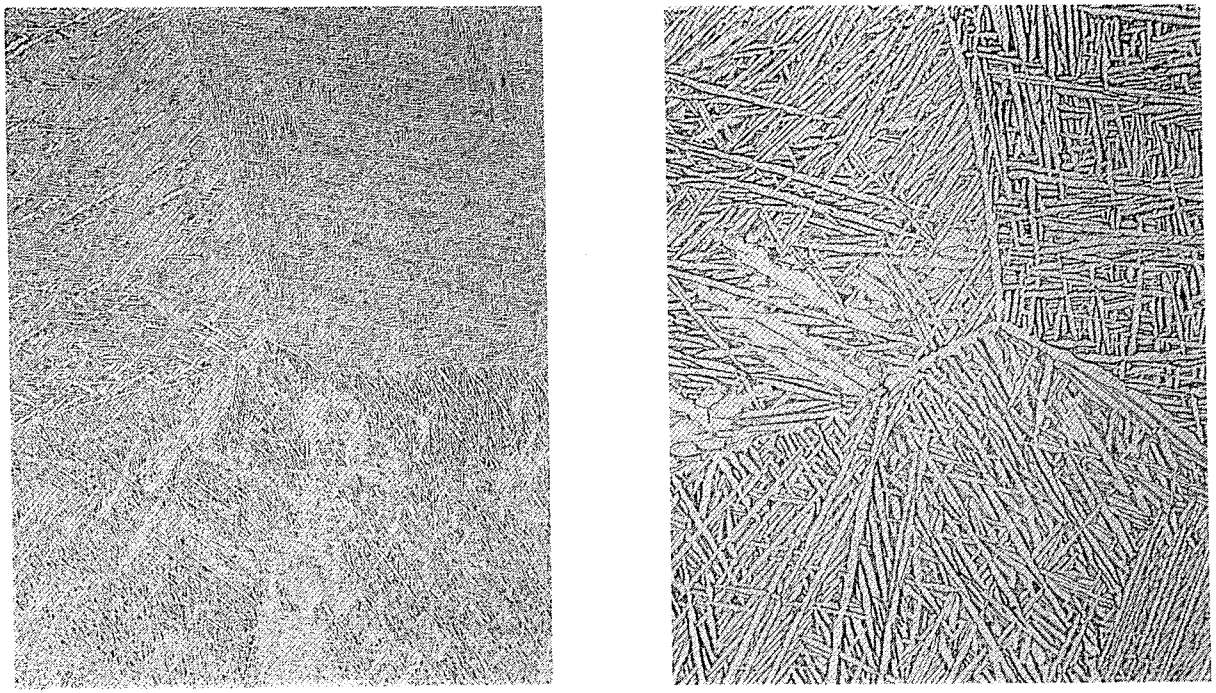
FIG. 7 is a photomicrograph of a third fan blade after being subjected to a stabilization temperature of 1750° F. for 30 minutes.

The temperature of this stabilization heat treatment may be selected so as to achieve relatively fine alpha platelets for example as shown in FIG. 5 for a stabilization heat treatment of 1500° F. for 30 minutes for the Ti-6%Al-4%V alloy. Coarser alpha platelet structures can also be achieved with high temperatures of exposure within the alpha/beta phase field as shown in FIGS. 6 and 7 which depict the microstructure resulting from the invention process utilizing stabilization temperatures of 1600° F. and 1750° F. respectively for 30 minutes for the Ti-6%Al-4% alloy. The variation in the microstructural morphology and dimensions of the alpha phase has been found to profoundly affect the properties of titanium articles as will be illustrated by the later example. Thus, selection of stabilization conditions allows a range of properties to be achieved for specific articles processed within the method of this invention. The time of the stabilization heat treatment and the method of cooling have also been found to affect the properties of the article processed according to the invention as will also be illustrated by examples.

The final step in the process of the invention is aging of the quenched and stabilized article to decompose a portion of the beta phase residing between the alpha platelets so as to adjust the tensile strength and tensile ductility of the article to the desired level. Aging results in an alpha/beta microstructure, the proportions of each depending upon the temperature and time of the aging step. It has been found that aging is best accomplished by exposure of the article at a temperature from 1000°–1300° F. for a time of 1 to 8 hours for the Ti-6%Al-4%V alloy.

Although this invention is critical to the successful implementation of a hollow titanium airfoil, the uses of the invention are not limited to it and appropriate uses include many other applications which can benefit from the unique balance of properties produced in an alpha/-beta alloy titanium casting through its use. These may include solid titanium airfoils such as blades or vanes, as well as impellers or mixed flow compressor stages intended for radial airflow applications in gas turbine engines. Other appropriate applications include but are not limited to static structure such as cases, struts, bearing supports, links and the like.

The invention process is broadly applicable to a variety of alpha/beta titanium alloys which contain alpha stabilizing elements which include but are not limited to aluminum, tin, nitrogen and oxygen together with beta stabilizers such as molybdenum, vanadium, iron, chromium or hydrogen. It is most broadly applicable to the alloys which contain room temperature equilibrium contents of the beta phase from 0 to about 25%. Such alloys include but are not limited to Ti-6%Al-4%V, Ti-6%Al-2%$S_n$-4%Ar-2%$M_o$ and Ti-6%Al-2%$S_n$-4%$Z_r$-6%$M_o$.

The process is also specifically applicable to the alpha or near alpha alloys which exhibit microstructural characteristics at low temperature which are morphologically similar to the alpha phase characteristics of the alpha/beta alloys. These alloys include but are not limited to commercially pure titanium and Ti-8%Al-1%$M_o$-1%V.

TABLE I

MECHANICAL PROPERTIES OF HEAT TREATED T1-6A1-4V

| PROCESS | SOLUTION TREATMENT | STABILIZATION | AGE | 0.2% Y.S. (KSI) | U.T.S. (KSI) | E-LONG % | R.A. % | CHARPY IMPACT (ft-lbs) | HCF $10^7$ Runout Stress (KSI) |
|---|---|---|---|---|---|---|---|---|---|
| Invention Process | 1925° F.(½ HR)WQ | + 1750° F.(½ HR)AC | + 1300° F.(2 HR)AC | 134.2 | 145.2 | 8.9 | 15.4 | 23 | 80 |
| | | | | 133.8 | 145.4 | 8.4 | 16.8 | 20 | |
| Invention Process | 1925° F.(½ HR)WQ | + 1700° F.(½ HR)AC | + 1300° F.(2 HR)AC | 137.2 | 148.9 | 6.4 | 12.4 | 17 | 80 |
| | | | | 138.0 | 149.7 | 7.8 | 11.6 | 18 | |
| Invention Process | 1925° F.(½ HR)WQ | + 1600° F.(½ HR)AC | + 1300° F.(2 HR)AC | 144.2 | 155.2 | 7.5 | 9.4 | 17 | |
| | | | | 143.0 | 152.5 | 3.8 | 4.0 | 13 | |
| Invention Process | 1925° F.(½ HR)WQ | + 1500° F.(½ HR)AC | + 1300° F.(2 HR)AC | 148.7 | 159.3 | 5.0 | 10.1 | 16 | 95 |
| | | | | 149.3 | 159.5 | 6.8 | 10.5 | 18 | |
| Invention Process | 1925° F.(½ HR)WQ | + 1750° F.(2 HR)AC | + 1300° F.(2 HR)AC | 148.0 | 160.6 | 4.8 | 7.8 | 19 | |
| | | | | 148.1 | 159.4 | 6.0 | 11.6 | 18 | |
| Invention Process | 1925° F.(½ HR)WQ | + 1600° F.(4 HR)AC | + 1300° F.(2 HR)AC | 138.5 | 153.3 | 10.0 | 16.1 | 17 | 80 |
| | | | | 137.3 | 149.1 | 7.9 | 7.8 | 15 | |
| Invention Process | 1925° F.(½ HR)WQ | + 1500° F.(4 HR)AC | + 1300° F.(2 HR)AC | 144.4 | 155.6 | 8.1 | 11.6 | 15 | |
| | | | | 144.6 | 155.0 | 7.1 | 9.0 | 15 | |
| Dual Cycle Process | 1925° F.(½ HR)WQ | + NONE | + 1100° F.(4 HR)AC | 153.0 | 162.2 | 3.0 | 3.6 | | 110 |
| | | | | 154.2 | 165.3 | 3.1 | 5.5 | | |
| Wrought Conventional Process | Forge to α-B structure (>90% Primary α) | | + 1300° F.(2 HR)AC | 134.0 | 141.0 | 16.8 | | 18–19 | 90 |
| Cast Conventional Process | HIP 1650° F. (15 KSI)(2 HR)FC | | + 1550° F.(2 HR)FC | 120.0 | 140.0 | 10.0 | 20.0 | 23 | 50–62 |

EXAMPLES

The results of the invention when applied to conventional Ti-6%Al-4%V titanium alloy castings which have been hot isostatically pressed at 1750° F. for 2 hours to eliminate internal shrinkage porosity are shown in Table I, together with data for a conventional titanium alloy casting and for a wrought titanium characteristic of the current process used to produce titanium fan blades for a gas turbine engine.

In this table it may be seen that the wrought fan blade condition produces a room temperature maximum allowable high cycle fatigue stress of approximately 90,000 psi at $10^7$ cycles life to failure. The conventional titanium casting process produces a maximum high cycle fatigue stress for similar life of about 50,000–62,000 psi.

Cast titanium material processed according to the invention produces an allowable high cycle fatigue stress of 80,000 to 95,000 psi which is clearly superior to that of conventional castings and competitive to that of the current wrought titanium fan blade structure. It may further be seen that while material processed at the highest stabilization temperature (1750° F.) shows a reduction in high cycle fatigue strength compared to that for material processed at the lowest stabilization temperature (1500° F.) within the invention, the material processed with the 1750° F. stabilization temperature displays superior charpy impact energy absorption (20–23 ft-lbs) compared to that of material processed at the lower 1500° F. stabilization temperature (16–18 ft-lbs) and also superior to that of the current wrought fan blade material (18–19 ft-lbs). Similarly the tensile strength of articles processed according to the invention may be increased by selection of lower stabilization temperatures or more rapid cooling rates from this temperature. Ductility of such articles may be increased by selection of high stabilization temperatures or slower cooling rates from this temperature. When no stabilization step is utilized the resulting structure exhibits very high strength and good high cycle fatigue characteristics but tensile ductility may be excessively low making the article unsuitable for applications where plastic deformation may be experienced in service as in gas turbine engine components such as fan blades, etc.

Thus, it can be seen by these examples that the present invention allows certain important properties of cast titanium articles to be tailored so as to be competitive with the properties of wrought articles by the previously disclosed application of temperatures, times and cooling rates to the cast titanium articles. Similarly the fatigue properties of cast titanium articles processed within the invention are clearly superior to those of conventional titanium castings while maintaining at least similar tensile strength and impact properties.

Although the invention has been shown and described in accordance with a preferred embodiment thereof, it should be understood by those skilled in the art that various changes and omissions in the form and detail thereof may be made therein without departing from the spirit and the scope of this invention.

Having thus described typical embodiments of our invention, that which we claim as new and desire to secure by Letters Patent of the U.S. is:

1. A method of heat treating a cast titanium alloy article comprising the steps of:

heating the article to a temperature above its beta transus temperature;

rapidly cooling the article to produce an acicular martensitic microstructure;

thermally decomposing the martensitic microstructure by stabilizing the article at a temperature between 1500°–825° F.; and aging the article at a temperature of 1000°–1300° F. for a time of 1 to 8 hours.

2. The method according to claim 1 wherein the alloy is a Ti-6%Al-4%V alloy.

3. The method according to claim 1 wherein said cooling step comprises quenching the article in liquid.

4. The method according to claim 3 wherein said cooling step comprises quenching the article in a liquid selected from the group consisting of water and oil.

5. The method according to claim 1 wherein said cooling step comprises quenching the article in a gas.

6. The method according to claim 5 wherein the step of rapid cooling is comprised of the step of quenching in a gas selected from the group consisting of argon and helium.

7. The method according to claim 1 further including the initial step of hot isostatically pressing the article.

8. A gas turbine airfoil produced by the method of claim 1.

9. An airfoil for use in a gas turbine engine or the like comprising a cast titanium alloy having a tensile strength of about 145 to 161 KSI produced by a method comprising the steps of:

heat treating the airfoil to a temperature above its beta transus temperature;

rapidly cooling the airfoil;

stabilizing the airfoil at a temperature between 1500°–1825° F.; and aging the airfoil at a temperature of 1000°–1300° F. for a time of 1 to 8 hours.

10. The airfoil according to claim 9 wherein the titanium alloy is Ti-6%Al-4%V.

11. The airfoil according to claim 9 wherein the titanium alloy has a Charpy impact strength of 12–24 ft-lbs.

12. An airfoil comprising:

a cast titanium alloy having a tensile strength of about 145 to 161 KSI.

13. The airfoil according to claim 12 wherein the alloy is Ti-6%Al-4%V.

14. The airfoil according to claim 12 produced by a method comprising the steps of:

heat treating the airfoil to a temperature above its beta transus temperature;

rapidly cooling the airfoil;

stabilizing the airfoil at a temperature within its alpha/beta phase field; and aging the airfoil at a temperature of 1000°–1300° F. for a time of 1 to 8 hours.

15. A method of heat treating a cast alpha/beta titanium alloy article comprising the steps of:

transforming the alpha/beta microstructure of the article to a substantially beta microstructure by heating the article to a temperature above its beta transus temperature;

converting the beta microstructure to a martensitic microstructure by rapidly quenching the article;

stabilizing the martensite into alpha and beta platelets by heating the article to a temperature between 1500°–1825° F.; and decomposing a portion of the beta microstructure into an alpha/beta microstructure by aging the article.

16. The method according to claim 15, wherein the step of transforming the alpha/beta microstructure into substantially beta microstructure takes place at a temperature between the beta transus temperature and the beta transus temperature plus 150° F.

17. The method according to claim 15 wherein the step of decomposing the beta microstructure is performed by aging at approximately 1300° F. for approximately 2 hours.

18. A method of providing a hollow cast titanium alloy article comprising the steps of:

casting a slightly oversized article around a leachable core within a mold by vacuum skull melting;

removing the article from the mold;

placing the article into a leaching agent to disintegrate the core;

milling an oxygen enriched layer off the article;

hot isostatically pressing the article;

heat treating the article to a temperature above its beta transus temperature;

rapidly cooling the article to produce an acicular martensitic microstructure;

thermally decomposing the martensitic microstructure by stabilizing the article at a temperature between 1500°-1825° F.; and aging the article at a temperature of 1000°-1300° F. for a time of 1 to 8 hours.

19. A method of heat treating a cast titanium alloy article to relatively inexpensively provide the article with mechanical properties similar to those of a wrought titanium alloy article, said method comprising the steps of:

heating the cast article;

cooling the heated article to produce therein a acicular martensitic microstructure;

stabilizing the cooled article at a first temperature in a manner casuing decomposition of the martensitic microstructure; and aging the stabilized article at a second temperature less than said first temperature.

20. The method according to claim 19 wherein said heating step comprises heating the article to a temperature above its beta transus temperature.

21. The method according to claim 19 wherein said stabilizing step comprises stabilizing the cooled article within a temperature range of from about 1500° F. to about 1825° F.

22. The method according to claim 21 wherein said aging step comprises aging the stabilized article within a temperature range having an upper temperature limit less than about 1500° F.

* * * * *